United States Patent [19]

Hazan et al.

[11] Patent Number: 4,713,514

[45] Date of Patent: Dec. 15, 1987

[54] MICROWAVE OVEN HAVING CONTROL MEANS WHICH REDUCE THE RISK OF NO-LOAD OPERATION

[75] Inventors: Jean-Pierre Hazan, Sucy-en-Brie; Michel Steers, La Queue-en-Brie, both of France

[73] Assignee: U.S. Philips Corporation, New York, N.Y.

[21] Appl. No.: 919,909

[22] Filed: Oct. 16, 1986

[30] Foreign Application Priority Data

Feb. 28, 1986 [FR] France ..... 86 02821

[51] Int. Cl.[4] ..... H05B 6/68

[52] U.S. Cl. ..... 219/10.55 B; 200/153 J; 219/10.55 C

[58] Field of Search ..... 219/10.55 B, 10.55 C; 200/153 J, 153 LA, 153 H, 337, 330, 254

[56] References Cited

U.S. PATENT DOCUMENTS 4,101,750 6/1978 Doner ..... 219/10.55 C

FOREIGN PATENT DOCUMENTS 514459 2/1929 Fed. Rep. of Germany ... 200/153 J 2141568 12/1983 United Kingdom ..... 219/10.55 B

*Primary Examiner*—Philip H. Leung

*Assistant Examiner*—Leon K. Fuller

*Attorney, Agent, or Firm*—Thomas A. Briody; William J. Streeter; Rolf E. Schneider

[57] ABSTRACT

The invention relates to a microwave oven comprising control means which reduce the risk of no-load operation and which co-operate with an actuating element which switches on the magnetron with the aid of power-supply means depending on open and closed states of the oven door. The invention is characterized in that the control means comprise a bistable electromechanical device which responds to closures of the door by counting the number of these closures and which enables the magnetron to be energized after an even number of closures of the door, one cycle of operation of the bistable electromechanical device comprising two open states and two closed states of the door. The bistable device may comprise a lever device which actuates a pendant-type electrical switch or a remote-controlled switch.

4 Claims, 2 Drawing Figures

MICROWAVE OVEN HAVING CONTROL MEANS WHICH REDUCE THE RISK OF NO-LOAD OPERATION

The invention relates to a microwave oven comprising control means which reduce the risk of no-load operation and which co-operate with an actuating element to energize a magnetron with the aid of power-supply means depending on open and closed states of the oven door.

An invention of this type is known from GB-A-No. 2,141,568. The specification describes a microwave oven in which the control means can create a situation which is intended to attract the attention of the user in order to preclude no-load operation of the magnetron of the oven, which may give rise to serious damage.

In order to draw the attention of the user certain operations have to be carried out before the oven can be put into operation. For this purpose the microwave oven is provided with a door switch which is opened or closed depending on whether the door is open or closed. Said specification describes control means which first detect whether the door switch is closed and then, during a subsequent sequence, in which the user should load the oven, detect whether this sequence comprises the operation of the oven door being opened and subsequently closed.

For this purpose the control means comprise a microprocessor whose program, which starts the aforementioned sequence, is controlled by the door switch.

However, such a solution necessitates the use of intricate electronic devices requiring a separate power supply.

SUMMARY OF THE INVENTION

It is the object of the invention to provide a simple, robust and reliable device which does not require a separate power supply and which is not affected by heat, cooking vapours and spurious electromagnetic fields, which are inevitable in this type of oven.

To this end an oven of the type defined in the opening paragraph is characterized in that the control means comprise a bistable electromechanical device which responds to closures of the door by counting the number of these closures and which enables the magnetron to be energised after an even number of closures of the door, one cycle of operation of the bistable electromechanical device comprising two open states and two closed states of the door.

In a first embodiment of the invention the bistable electromechanical device comprises a lever device which actuates a pendant-type electrical switch.

In a second embodiment a device may comprise a wiper switch which actuates a remote-controlled switch.

Embodiments of the invention will now be described in more detail, by way of example, with reference to the accompanying drawings.

DESCRIPTION OF THE PREFERRED EMBODIMENT

Figure 1:
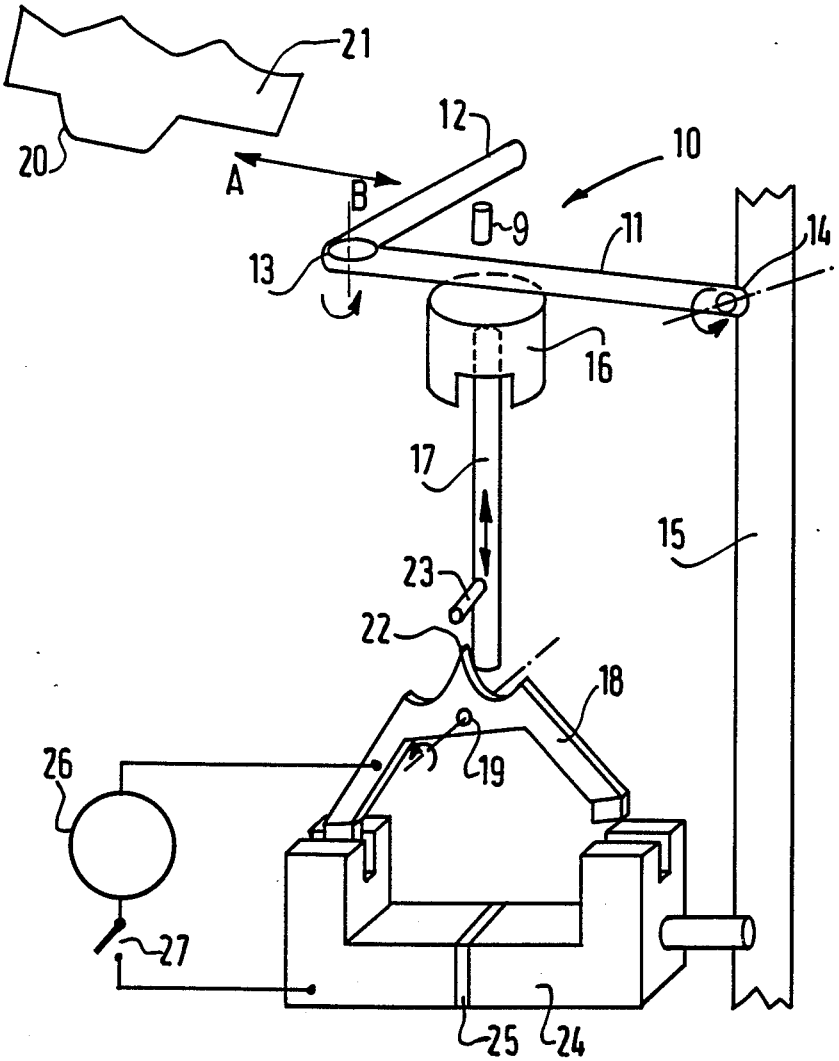
FIG. 1 schematically shows a first embodiment, and
FIG. 2 schematically shows a second embodiment.

FIG. 1 schematically shows a cam 20 arranged on the oven door 21. The opening/closing movement of the door causes the cam 20 to be moved in the directions B and A respectively, i.e. when the movement is considered over a small distance only, at the location of a lever device 10. This lever device comprises a first arm 11 which is movable in one direction and a movable second arm 12 which is pivotable about a pivot 13. The movable arm 12 can move in the two directions A and B indicated by the double arrow, to perform a pivotal movement about the pivot 13.

In the case of a movement in the direction A the movable arm 12 is moved by the cam 20 and assumes a position which makes an angle with arm 11 greater than 90° so that it is nearly in line with the arm 11, so that it is actuated by the cam 20.

When the movable arm 12 is not actuated by the cam 20 it is subjected to a return force provided by, for example, a spring which returns the movable arm 12 to a position in which it is disposed at the certain angle, for example approximately 90°, relative to the arm 11.

When the cam moves back in the direction B during opening of the oven door, it meets the movable arm 12. However, in this direction it cannot be moved farther than a stop 9, which retains it in the preceding position. The device is constructed in such a way that in its direction of movement B the oven door causes the cam 20 to move over the top of arm 12 beyond the stop position of the movable arm 12. When, the arm 20 moves over the movable arm 12 the arm 11 moves downwards, which arm is movable about a pivot 14 secured to a fixed rigid part 15 of the oven. The operation of the arms 11 and 12 are such that downward movement of arm 11 and arm 12 only occurs during movement of cam 20 in the direction of B. During the movement of cam 20 in the direction of A, arm 12 is permitted to move away from stop 9, permitting arms 11 and 12 to return to their upward positions.

Only during its pivotal movement downward, the arm 11 actuates a pendant-type electrical switch. This switch basically comprises a cap 16 which is mounted so as to be freely movable on a spindle 17 which is translatable along its axis of symmetry and which is subjected to a return force. By means of a pin 23 this spindle 17 causes a yoke 18 to be pivoted between two stable positions about a friction spindle 19. The yoke 18 comprises a pointed portion 22 such that the pin 23 is alternately guided by one side or the other side of the pointed portion 22 each time that the spindle 17 is moved towards the yoke 18. Thus, each limb of the yoke 18 is alternately in contact with a base 24 comprising two parts which are electrically insulated from each other by an insulator 25, the base being rigidly connected to a stationary rigid portion 15 of the oven. Thus, an electrical connection is established between the yoke 18, the electronic control means of the magnetron 26, the customary on-off switches 27 for switching on the oven for safety purposes only when the oven door is closed, and a part of the base.

A complete cycle of operations proceeds as follows. The cam 20 moves a first time in the direction B and sets the yoke to the position shown in FIG. 1. When the cam 20 moves back in the direction A, the cam 12 moves back and does not change the position of the yoke 18. The cam 20 continues to pivot the arm 12 in the direction A during opening of the door until the end of arm 12 clears the cam 20, permitting it to return under spring force to the position shown, and the door is then closed. Only during movement in the B direction can the yoke 18 change position. The cam 20 moves again during a subsequent opening of the door in the direction B, as a result of which the yoke 18 is pivoted to a position opposite to that shown in FIG. 1. The next movement of the cam 20 in the direction of B causes the yoke to be moved again to the position shown in FIG. 1, actuating the cap 10, spindle 17 and yoke 18 assembly. However, switch 27 will be open, prohibiting energization of the magnetron until the oven door is returned to its closed position. This means that two closing operations are required to obtain the same position of the yoke. The magnetron can only be switched on after every two closing cycles, the object of this being to attract the attention of the user in order to ensure that the oven is loaded and to preclude no-load operation.

Figure 2:
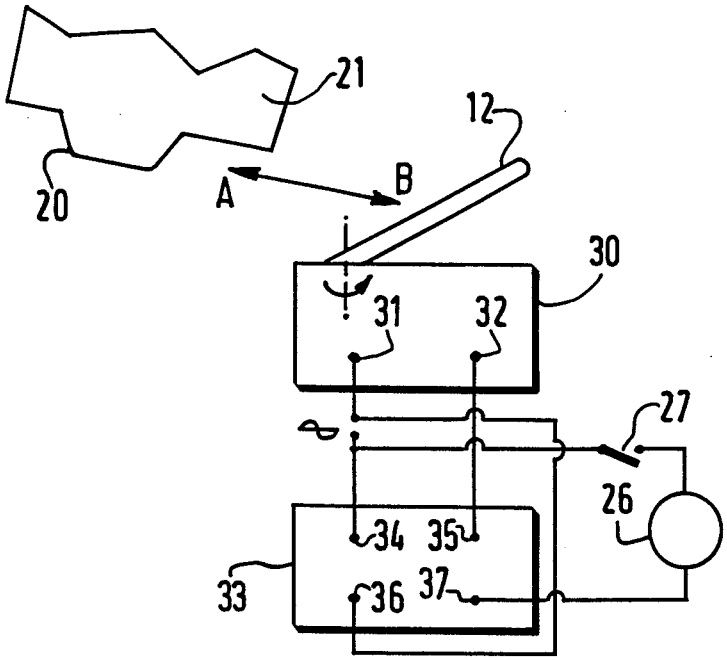

FIG. 2 shows a second embodiment of the invention. The movable arm 12 of a wiper switch 13 operates in the same way as described above. It co-operates with the cam 20 of the door 21 in exactly the same way as described in the foregoing during the movements in the directions A and B. During these movements of the movable arm 12 the electric contact between the terminals 31 and 32 of the switch 30 is alternately broken and made. In this way said switch 30 controls a remote-controlled switch 33, which is changed over under the influence of electric pulses appearing on the terminals 34, 35 as a result of the closure of the contacts 31, 32. This remote-controlled switch is connected to the electronic control means of the magnetron 26 and to a general on-off switch 27. The remote-controlled switch should receive two pulses to return to the same position. Thus, in the same way as in the preceding embodiment, the magnetron can be energized only after every two closing cycles of the oven door.

These devices are simple, robust, not very expensive and require no separate power supply.

What is claimed is:

1. A microwave oven safety control comprising:

an oven door operated cam member, said cam member being displaced in a first direction during opening of said oven door, and in a second opposite direction during closing of said door;

a first pivot arm having one end connected to a rigid base about a pivot connection which permits said first arm to pivot in a vertical direction and which is biased upwardly by a spring;

a second pivot arm located in the path of said cam member connected through a second pivot connection to a remaining end of said first pivot arm, said second pivot arm being pivoted in said first and second directions and being restrained from pivoting by a stop when said cam member moves in said first direction, forcing said first and second pivot arms downward about said first pivot connection, said second pivot arm being pivoted away from said stop when said cam member moves in said second direction, permitting said first and second arms to move upwardly; and a pendant type electrical switch having a linear actuation member which changes the state of said switch between a closed and open, and open and closed state only when it is moved in a downward direction, said linear actuating member being positioned under said first arm for actuation each time said first arm moves downwardly, whereby said electrical switching state changes from a closed state to an open state and then back to a closed state when said door is opened two consecutive times.

2. The microwave oven safety control of claim 1 further comprising a second switch in series with said pendant switch, said second switch connected to said oven door to open and close when said oven door opens and closes.

3. A microwave oven safety control comprising:

a first switch having a movable arm which is pivotably connected to move in first and second opposite directions which opens and closes a set of contacts;

a cam member connected to a door of a microwave oven, said cam member moving, during opening of said door, into the plane of said movable arm, closing said set of contacts, and opening said set of contacts when said cam member is moved in an opposite direction during closing of said oven door;

a remote controlled switch connected to said set of contacts on said first switch, said remote controlled switch having a set of contacts which change state each time said first switch contacts close, whereby two closures of said first switch contacts are necessary to change said remote controlled switch from an open to a closed switch condition; and, circuit means connected to said remote controlled switch contacts for energizing a heating circuit of said microwave oven.

4. The microwave oven safety control of claim 3 wherein said circuit means includes an oven door switch for inhibiting energization of said heating conduit until said oven door is closed.

* * * * *

UNITED STATES PATENT AND TRADEMARK OFFICE

CERTIFICATE OF CORRECTION

PATENT NO. : 4.713.514

DATED : December 15. 1987

INVENTOR(S) : Jean-Pierre Hazan et al

It is certified that error appears in the above-identified patent and that said Letters Patent is hereby corrected as shown below:

IN THE CLAIMS

Claim 4. line 3 change "con-" to --cir--- line 4 change "duit" to --cuit--

Signed and Sealed this

Fourth Day of October, 1988

*Attest:*

*Attesting Officer*

DONALD J. QUIGG

*Commissioner of Patents and Trademarks*